US008037827B2

(12) United States Patent
Kopf et al.

(10) Patent No.: US 8,037,827 B2
(45) Date of Patent: Oct. 18, 2011

(54) FUZE FOR A PROJECTILE

(75) Inventors: Marcus Kopf, Zimmern-Stetten O.R. (DE); Frank Martin Kienzler, Villingen-Schwenningen (DE); Gerd Giesler, Mönchweiler (DE); Herbert Höni, Aichhalden-Rötenberg (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 111 days.

(21) Appl. No.: 12/496,733

(22) Filed: Jul. 2, 2009

(65) Prior Publication Data

US 2010/0005993 A1 Jan. 14, 2010

(30) Foreign Application Priority Data

Jul. 11, 2008 (DE) ..... 10 2008 032 744

(51) Int. Cl.
*F42C 9/10* (2006.01)

(52) U.S. Cl. ..... 102/277.1; 102/266; 102/275.11; 102/269

(58) Field of Classification Search ..... 102/265, 102/266, 268, 269, 277.1, 277.2, 275.11
See application file for complete search history.

(56) References Cited

U.S. PATENT DOCUMENTS

| | | | | | |
|---|---|---|---|---|---|
| 3,119,338 | A * | 1/1964 | Pissacroia | 102/275.9 |
| 3,815,505 | A * | 6/1974 | Roh et al. | 102/210 |
| 3,945,323 | A * | 3/1976 | Boswell | 102/222 |
| 3,982,487 | A * | 9/1976 | Richelle et al. | 102/277.1 |
| 4,811,664 | A * | 3/1989 | Levy et al. | 102/226 |
| 4,873,927 | A * | 10/1989 | Rudenauer | 102/269 |
| 5,003,879 | A * | 4/1991 | Jones | 102/204 |
| 5,375,526 | A * | 12/1994 | Hoffmann | 102/269 |
| 5,467,713 | A * | 11/1995 | Roosmann et al. | 102/233 |
| 5,576,510 | A * | 11/1996 | Rudenauer | 102/231 |
| 5,591,935 | A * | 1/1997 | Shamblen et al. | 102/500 |
| 6,578,489 | B2 * | 6/2003 | Boyer et al. | 102/272 |
| 6,640,719 | B1 * | 11/2003 | Pacella et al. | 102/277.1 |
| 7,650,840 | B2 * | 1/2010 | Childs et al. | 102/276 |

* cited by examiner

*Primary Examiner* — James Bergin
(74) *Attorney, Agent, or Firm* — Laurence A. Greenberg; Werner H. Stemer; Ralph E. Locher

(57) ABSTRACT

A fuze for a projectile has a firing assembly for firing a main charge of the projectile and a delay detonator for firing the firing assembly after a delay time which is defined by a burning distance of a delay charge. The delay detonator has a housing with a fuze half in which it is fired and a detonator half which contains a detonator charge for firing the firing assembly. In order to prevent the projectile from misfiring as a result of premature detonation of the delay detonator, the housing has a relief opening in the fuze half, with an opening cross section that can be passed through freely in the firing state of the delay detonator.

10 Claims, 2 Drawing Sheets

FUZE FOR A PROJECTILE

CROSS-REFERENCE TO RELATED APPLICATION

This application claims the priority, under 35 U.S.C. §119, of German application DE 10 2008 032 744.1, filed Jul. 11, 2008; the prior application is herewith incorporated by reference in its entirety.

BACKGROUND OF THE INVENTION

Field of the Invention

The invention relates to a fuze for a projectile having a firing assembly for firing a main charge of the projectile and having a delay detonator for firing the firing assembly after a delay time which is defined by a burning distance of a delay charge. The delay detonator has a housing with a fuze half in which it is fired and a detonator half which contains a detonator charge for firing the firing assembly.

Fuzes for artillery projectiles, mortar shells or direct-fire projectiles are normally provided with a firing assembly having a firing chain by way of which a main charge in the projectile is fired. The firing assembly or firing chain comprises a firing charge which is fired electronically or mechanically at a specific time or in a specific fuze situation, and which passes its firing energy directly to the main charge or, for example, to a booster charge in the firing chain, which itself fires the main charge.

When such mechanical or electronic initiation of the firing charge fails, the projectile becomes an unexploded munition after it has landed, which represents a considerable source of danger for a very long time period. An unexploded munition such as this can arise, for example, when a projectile with an impact fuze lands in deep snow or in a snow drift and the impact fuze does not fire, or the projectile strikes the ground at such a flat angle that it slides over the ground and comes to rest only slowly.

In order to ensure firing even in an irregular situation such as this, it is known for the fuze to be provided with a delay detonator which is fired for example on firing of the projectile and fires the firing assembly after a preset delay time of a number of seconds, when this firing assembly has not already been fired in the normal manner by a time fuze or impact fuze or the like. A delay detonator such as this normally comprises a delay charge which, for example, is fired when the projectile is fired and which—in a similar manner to a detonation cord—burns for a defined time period in order to transfer firing energy to a detonator, in order to fire the firing assembly, once this delay time has elapsed.

SUMMARY OF THE INVENTION

It is accordingly an object of the invention to provide a fuze for a projectile which overcomes the above-mentioned disadvantages of the heretofore-known devices and methods of this general type and which specifies a fuze for a projectile that provides reliable protection against becoming an unexploded munition.

With the foregoing and other objects in view there is provided, in accordance with the invention, a fuze for a projectile, comprising:

a firing assembly for firing a main charge of the projectile; and a delay detonator for firing said firing assembly after a delay time defined by a burning distance of a delay charge;

said delay detonator having a housing with a fuze half, wherein said detonator is fired, and a detonator half containing a detonator charge for firing said firing assembly;

said fuze half of said housing having a relief opening formed therein with an opening cross section that is freely passable when said delay detonator is in a firing state.

In other words, the objects are achieved by a fuze of the type mentioned initially, in which, according to the invention, the housing in the fuze half has a relief opening with an opening cross section that can be passed through freely when the delay detonator is in the firing state.

The invention is based on the concept that the delay time can be set very precisely by way of a delay charge. Furthermore, the burning of a delay charge is very robust when subjected to mechanical loads, as a result of which the firing of the firing assembly by the delay detonator can also take place when the fuze has in the meantime been subjected to high loads, such as those which can occur when the projectile is being fired and on impact. However, the high mechanical load which occurs when the projectile is fired can result in the homogeneous structure of the combustion material in the delay charge being somewhat interfered with. If high pressure peaks occur as a result of non-uniform combustion when the delay detonator is fired, hot combustion gases can pass through the delay charge as a result of inhomogeneities in the fuel structure, for example microcracks, thus bridging the delay charge and prematurely firing the detonator charge. If it is fired prematurely, a firing charge of the firing assembly may possibly not yet have been armed, and initiation of the firing assembly by the detonator of the delay detonator will be prevented.

Pressure peaks which can occur as a result of firing of the delay detonator can be dissipated through a relief opening in the fuze half of the housing of the delay detonator, as a result of which the pressure that builds up is not sufficient to force hot combustion gases through the delay charge. Bridging of the delay charge can be reliably prevented, and firing of the firing assembly after the defined delay time can be ensured.

When the delay detonator is being fired, the relief opening allows gas to pass freely from a charge of the delay detonator into its surrounding area. When the delay detonator is being fired, the relief opening is provided with an opening cross section which can be passed through freely and has a size of at least 1 $mm^2$. This allows sufficient gas to escape through the relief opening in order to dissipate pressure peaks. Pressure relief in the fuze half becomes even more necessary the greater the pressure peaks which occur on firing. In order to allow even large pressure peaks to be dissipated, which can occur in the event of high mechanical loads or as a result of inhomogeneities in charges, the relief opening expediently has an opening cross section, which can be passed through freely when the delay detonator is being fired, of at least 5 $mm^2$.

The housing of the delay detonator expediently surrounds all the charges of the delay detonator, for example a piercing charge, a relay charge between the piercing charge and a delay charge, and possibly a further relay charge and a detonator charge. Since the pressure peaks are formed predominantly on firing of the delay detonator, the relief opening is arranged in the fuze half of the housing, that is to say in the half in which the delay detonator is fired, for example by means of a piercing needle which is pushed into a firing charge.

When using a firing needle, the same is passed through the housing in order to fire the delay detonator, and the housing may have a piercing opening for this purpose. When the delay detonator is being fired, that is to say in the state in which the firing needle enters a firing charge and fires it, this piercing opening is blocked by the firing needle to such an extent that it cannot be used as a relief opening. A small slot between the firing needle and the housing is sufficient for use as a relief opening only if it has an aperture with a size of at least 1 $mm^2$, which must also not be covered by an element of the firing needle, for example a cover or stop.

In accordance with an advantageous feature of the invention, the relief opening opens directly to a piercing charge of the delay detonator. Pressure peaks which occur when the piercing charge is being fired can be dissipated particularly well through this opening. It is likewise possible to arrange the relief opening on a relay charge between a piercing charge and a delay charge, in order to dissipate pressure peaks which can occur when energy is being transferred from one charge to another. It is also advantageous for the relief opening to be arranged both on the piercing charge and on the relay charge.

In order to provide longer delay times, the delay detonator is expediently made elongated, such that its length in a burning direction is longer, in particular more than twice as long, than its extent in the two other spatial directions.

In order to provide a compact fuze, it is advantageous to arrange the elongated delay detonator transversely with respect to a direction of flight of the projectile. To this end, the burning direction of the delay detonator, that is to say the direction advantageously transversely with respect to a direction of flight of the projectile, is expediently located at an angle of between 70° and 110° with respect to the direction of flight of the projectile, in particular at right angles to the direction of flight of the projectile. The burning direction is the direction in which a delay charge of the delay detonator burns, for example from a piercing charge to the detonator charge.

In one advantageous refinement of the invention, the piercing opening and the relief opening are two separate openings in the housing. This makes it possible to separate the processes of piercing and pressure relief, and the openings can be optimized for reliable firing of the delay detonator and for good pressure relief. Alternatively or additionally, it is possible for the relief opening to form the piercing opening at the same time, through which a piercing needle can be passed in order to fire the delay detonator.

The delay detonator is advantageously pierced when the projectile is fired and using the firing acceleration. In this case, a particularly simple fuze design can be achieved if a piercing direction of the piercing needle through the piercing opening is in the opposite direction to the direction of flight of the projectile. The arrangement of the piercing direction parallel to but in the opposite direction to the direction of flight of the projectile makes it possible to make use of the inertia of the piercing needle for acceleration and piercing into the delay detonator, without any need for other propulsion means.

Hot combustion gases can be forced through the delay detonator when a pressure peak occurs only when there is a corresponding opposing pressure in the opposite direction to the burning direction in the delay detonator. The production of an opposing pressure such as this can be counteracted particularly effectively by arranging the relief opening with respect to a piercing opening in the housing in the opposite direction to a burning direction of a delay charge. Accelerated, hot gases can leave the delay detonator without changing direction, thus making it possible to dissipate pressure particularly effectively.

The relief opening is advantageously arranged opposite a detonator opening in the housing. Pressure relief in the opposite direction to the burning direction can in this way be achieved in a particularly simple form. In this case, the relief opening can be incorporated on a rear face of the housing which, in particular, is arranged parallel to the front face. Rear and front can in this case be defined by the fuze half which is the rear half and the detonator half, which is the front half.

In a further advantageous refinement of the invention, the delay detonator is provided in order to accelerate an armed firing charge of the firing assembly against a piercing needle. The firing assembly can be fired and the main charge can in this way be caused to detonate.

The invention can be used particularly advantageously in the case of a fuze which is an impact fuze. If there is no impact or the impact is too weak, the firing energy which is required to fire the firing assembly can be made available by the delay detonator, for example by accelerating the firing charge of the firing assembly against the piercing needle.

Other features which are considered as characteristic for the invention are set forth in the appended claims.

Although the invention is illustrated and described herein as embodied in a fuze for a projectile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
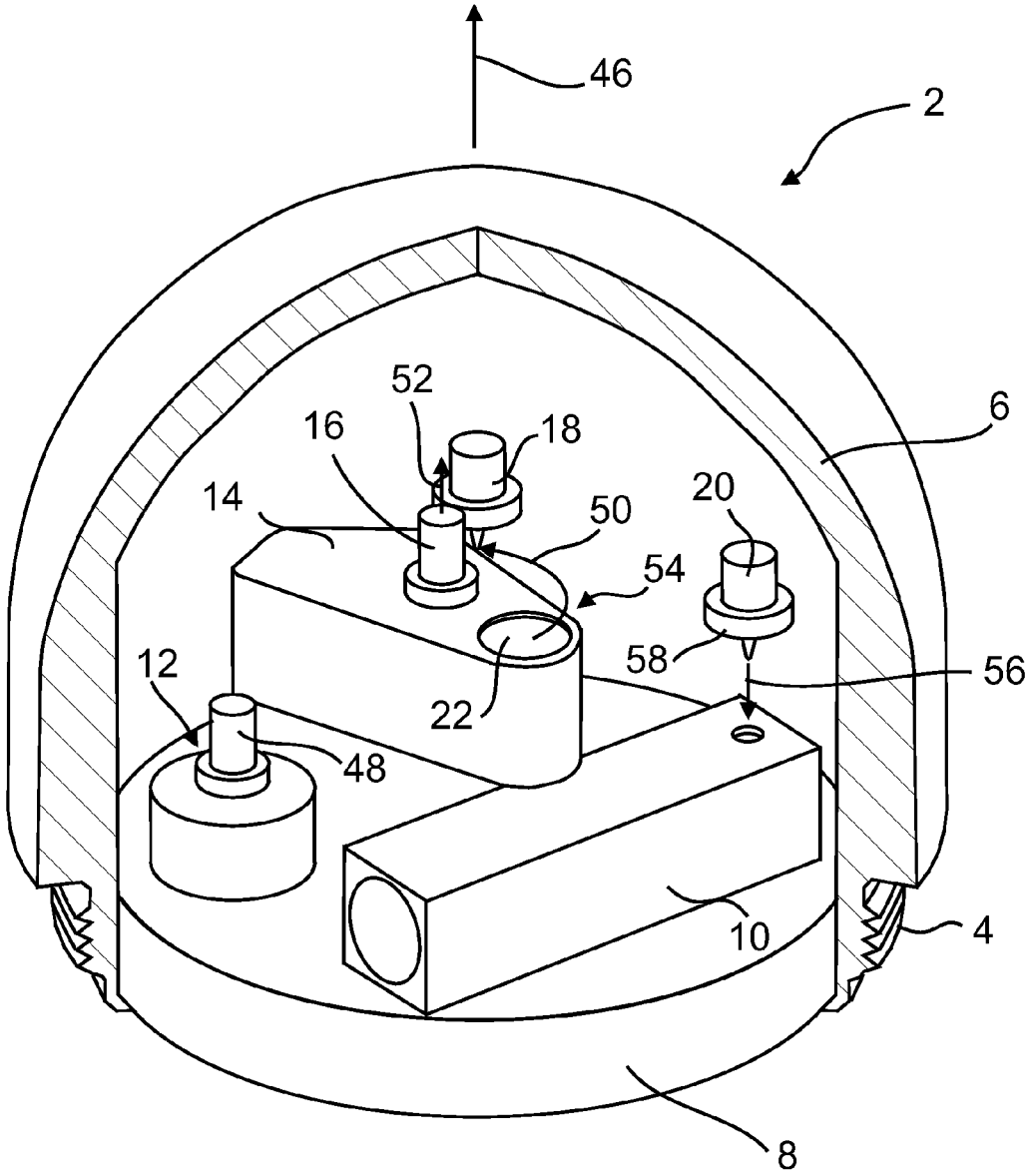
FIG. 1 shows a schematic perspective illustration of a fuze with a delay detonator.

Referring now to the figures of the drawing in detail and first, particularly, to FIG. 1 thereof, there is shown a fuze 2 of a projectile, which is not illustrated in any more detail, for example of a mortar shell, an artillery projectile, or a direct-fire, self-propelled projectile in the form of a partially sectioned and highly simplified illustration. The fuze 2 is an impact fuze and can be screwed into a projectile body via a thread 4, by which means the projectile is produced. The fuze 2 comprises a fuze housing 6 with a base 8 on which elements of the fuze 2 are fixed, for example a delay detonator 10 and, alongside this, a double-bolt system 12, only part of which is illustrated, schematically, for clarity. The figure likewise only indicates a rotor 14, which can rotate about a bolt 16, and two piercing needles 18, 20 for firing a firing charge 22 in the rotor 14 and a piercing charge 24 (see FIG. 2) in the delay detonator 10, whose mounting in the fuze housing 6 is likewise not illustrated, for clarity.

Figure 2:
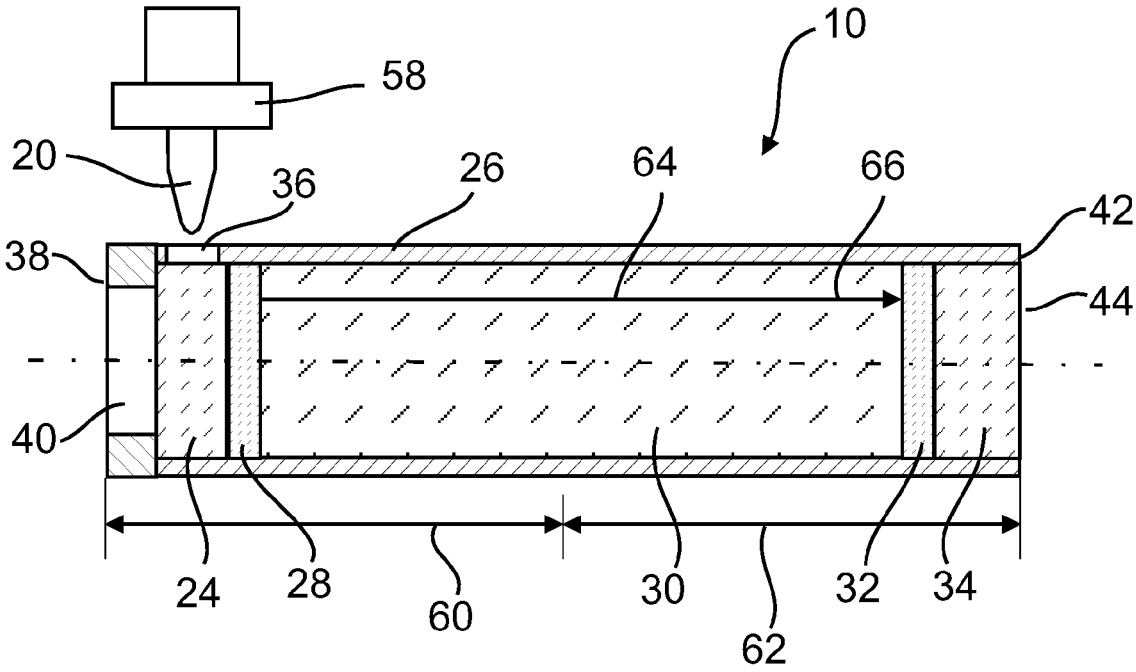
FIG. 2 shows the delay detonator in the form of a sectioned side view.

FIG. 2 shows the delay detonator 10 in the form of a sectioned illustration. The piercing charge 24, a relay charge 28, a delay charge 30, a further relay charge 32 and a detonator charge 34 are arranged from front to rear in a housing 26. The housing 26 is provided in the area of the piercing charge 24 with a piercing opening 36 through which the piercing needle 20 can be inserted into the piercing charge 24. The housing 26 is provided with a relief opening 40, on the rear face 38 of the housing 26 and likewise in the area of the piercing charge 24. On the opposite front face 42, the housing 26 is open, thus forming a large detonation opening 44. The delay detonator 10 is a good 20 mm long, and the diameter of the relief opening is about 3.5 mm.

When the projectile is fired, the fuze 2 is accelerated very greatly in the direction of flight 46. This results in a bolt 48 which is indicated in the double-bolt system 12 being forced downward, that is to say in the direction of the projectile body, and, with it, a second bolt, which is not illustrated, of the double-bolt system 12. This unlocks the rotor 14, which is rotated about the bolt 16 by an appropriate mechanism, such that the firing charge 22 is moved under the piercing needle 12, corresponding to the arrow 50. When the projectile strikes a target, the fuze 2 is accelerated very greatly in the opposite direction to the direction of flight 46, as a result of which the rotor 14 is moved upward, that is to say in the direction of flight 46, relative to the fuze housing 6, as is indicated by an arrow 52. The piercing needle 18 remains fixed in the fuze housing 6, as a result of which the firing charge 22 is forced against the piercing needle 18 and is fired. The firing charge 22 results in firing energy being forced through the base 8 onto a main charge, which is not illustrated, of the projectile, and thus firing this main charge. The firing charge 22, the rotor 14 and the piercing needle 18 are components of a firing assembly 54 which, if required, may also comprise one or two further charges in a firing chain.

If the projectile makes a soft landing or the projectile decelerates slowly when making a flat landing on flat ground, the deceleration of the fuze 2 may be too low to force the rotor 14 upwards in the direction of flight 46 and to force the firing charge 22 against the firing needle 18. The projectile comes to rest without the main charge being detonated, and thus becomes an unexploded munition. In order to prevent this, the fuze 2 is provided with the delay detonator 10, which is fired when the projectile is fired. When the projectile is fired, the piercing needle 20, which is mounted in the fuze housing 6 so that it can move, is accelerated by its inertia relative to the fuze housing 6 in the piercing direction 56, that is to say in the opposite direction to the direction of flight 46, towards the delay detonator 10, as a result of which its point is moved through the opening 36 in the housing 26 into the piercing charge 24. Its movement into the piercing charge 24 is stopped by a stop 58, in the form of a flange on the piercing needle 20, with the stop 58 resting like a cover all round the piercing opening 36 when the piercing charge 24 is fired, thus closing the piercing opening 36.

The piercing charge 24 fires the relay charge 28 which itself fires the delay charge 30. The delay charge 30 is set such that it burns for a period of 15 seconds from its rear end on the relay charge 28, until the burning process arrives at its front end, and thus at the relay charge 32. The relay charge 32 is fired after this 15-second period and itself fires the detonator charge 34, which emits a powerful gas pressure shock outwards. This gas pressure shock accelerates the rotor 14 in the direction of flight 46, as a result of which the firing charge 22 is forced against the piercing needle 18 and is fired. This results in the main charge of the projectile being fired at the latest after 15 seconds, if it has not already been fired in the normal manner prior to this by impact of the fuze 2.

When the piercing charge 24 and the relay charge 28 are fired, it is possible for a high gas pressure to be formed within the housing 26, in the area of the piercing charge 24 and/or of the relay charge 28. This can result in hot gases being suddenly forced through the delay charge 30, particularly if the delay charge 30 has microcracks or the like which, for example, can be created when the projectile is fired. The relay charge 32 is fired immediately and, with it, the detonator charge 34, thus producing the gas pressure shock in order to lift the rotor 14 during or shortly after the firing of the projectile. At this time, the rotor 14 has not yet been rotated to its unlocked position, as a result of which the firing charge 22 can not yet be forced against the piercing needle 18. The main charge is not detonated and will also not be detonated if the impact is too small. The projectile becomes an unexploded munition. Furthermore, the rotor 14 may be damaged by the gas pressure shock of the detonator charge 34, as a result of which it may become jammed and cannot rotate to its armed position. The firing charge 22 can in this way not be fired even when a normal impact occurs, and the projectile in any case becomes an unexploded munition.

In order to prevent this, the relief opening 40 is introduced in the fuze half 60 of the delay detonator 10. The fuze half is the rear half, on the basis of its dimensions, of the delay detonator 10. The firing charge 22 is located in it. The front half of the delay detonator 10 is its detonator half 62, in which the detonator charge 34 is located. Undesirable pressure peaks are dissipated through the relief opening 40 by the capability for combustion gases to escape from the housing 26 through the relief opening 40. The delay charge 30 can burn in the normal manner, thus reliably preventing the projectile from becoming an unexploded munition.

In order to allow a long burning distance 64 in the burning direction 66, the delay charge 30 is elongated and, with it, the delay detonator 10. In order to achieve a compact fuze 2, the longitudinal direction of the elongated delay detonator 10 and, with it, a burning direction 66 of the delay charge 30 are arranged at right angles to the direction of flight 46. In order to make use of the inertia of the piercing needle 20 to fire the delay detonator 10, the piercing needle 20 is arranged such that it is introduced into the housing 26 from the side, with respect to the longitudinal direction of the delay detonator 10 and the burning direction 66, in order to fire the delay detonator 10.

The invention claimed is:

1. A fuze for a projectile, comprising:

a firing assembly for firing a main charge of the projectile; and a delay detonator for firing said firing assembly after a delay time defined by a burning distance of a delay charge;

said delay detonator having a housing with a fuze half, wherein said detonator is fired, and a detonator half containing a detonator charge for firing said firing assembly;

said fuze half of said housing having a relief opening formed therein with an opening cross section that is freely passable when said delay detonator is in a firing state.

2. The fuze according to claim 1, wherein said relief opening has an opening cross section of at least 5 $mm^2$.

3. The fuze according to claim 1, wherein said relief opening opens directly to a piercing charge of said delay detonator.

4. The fuze according to claim 1, wherein said delay detonator has a defined burning direction extending transversely with respect to a direction of flight of the projectile.

5. The fuze according to claim 1, wherein said housing, in addition to said relief opening, is also formed with a piercing opening for insertion of a piercing needle in order to fire said delay detonator.

6. The fuze according to claim 5, wherein a piercing direction of said piercing needle through said piercing opening is opposite to a direction of flight of the projectile.

7. The fuze according to claim 1, wherein said relief opening is disposed, with respect to a piercing opening in said housing, in an opposite direction to a burning direction of said delay charge.

8. The fuze according to claim 1, wherein said relief opening is formed opposite a detonator opening in said housing.

9. The fuze according to claim 1, wherein said delay detonator is provided in order to accelerate an armed firing charge of said firing assembly against a piercing needle.

10. The fuze according to claim 1 configured as an impact fuze.

* * * * *